US007360648B1

(12) United States Patent
Blaschke

(10) Patent No.: US 7,360,648 B1
(45) Date of Patent: Apr. 22, 2008

(54) GUN PROTECTOR

(75) Inventor: Emil Blaschke, Yoakum, TX (US)

(73) Assignee: TBAC Investment Trust, Arlington, TX (US)

( * ) Notice: Subject to any disclaimer, the term of this patent is extended or adjusted under 35 U.S.C. 154(b) by 484 days.

(21) Appl. No.: 10/942,330

(22) Filed: Sep. 15, 2004

(51) Int. Cl.
*B65D 85/00* (2006.01)

(52) U.S. Cl. ..... 206/317; 224/913

(58) Field of Classification Search ..... 206/317, 206/3, 315.1, 315.11; 150/154; 224/600–659, 224/913; 383/25, 66, 67, 112, 907; 42/96
See application file for complete search history.

(56) References Cited

U.S. PATENT DOCUMENTS

| | | | | |
|---|---|---|---|---|
| 2,542,667 | A | 2/1951 | Hanson | |
| 2,574,730 | A | 11/1951 | Crew et al. | |
| 2,913,030 | A | 11/1959 | Fisher | |
| 3,164,189 | A * | 1/1965 | O'Link | 206/317 |
| 3,191,652 | A * | 6/1965 | Benson et al. | 206/317 |
| 3,437,247 | A * | 4/1969 | Gantress | 206/317 |
| 3,540,508 | A | 11/1970 | Couch | |
| 3,701,371 | A * | 10/1972 | Stackhouse | 206/317 |
| 4,024,997 | A | 5/1977 | Kolpin | |
| 4,280,644 | A * | 7/1981 | Shindelka | 224/149 |
| 5,431,970 | A | 7/1995 | Brown et al. | |
| 5,678,344 | A * | 10/1997 | Jones et al. | 42/96 |
| 5,850,706 | A * | 12/1998 | Evans | 42/96 |
| 6,068,401 | A * | 5/2000 | Ho | 383/97 |
| 6,119,388 | A * | 9/2000 | Jones et al. | 42/96 |
| 6,256,922 | B1 | 7/2001 | Jones et al. | |
| 6,626,339 | B2 | 9/2003 | Gates et al. | |
| D520,235 | S * | 5/2006 | Blaschke | D3/262 |
| 7,185,607 | B1 * | 3/2007 | Pearson | 1/1 |
| 2005/0011786 | A1 * | 1/2005 | Wood et al. | 206/315.11 |

* cited by examiner

*Primary Examiner*—J. Gregory Pickett
(74) *Attorney, Agent, or Firm*—Winstead PC

(57) ABSTRACT

A casing for enveloping and protecting a firearm comprising of a body section having a front portion, a middle portion, a rear portion, an upper edge and a plurality of lower edges. The upper edge extending longitudinally between a firearm barrel end of the casing and a firearm stock end of the casing, the firearm barrel end of the casing dimensioned to essentially surround the ending barrel portion of a firearm when insertably introduced therein and the firearm stock end of the casing dimensioned to essentially surround a stock portion of a firearm when insertably introduced therein; the plurality of lower edges extending longitudinally between the firearm stock end of the casing and the front portion of the body section.

21 Claims, 2 Drawing Sheets

GUN PROTECTOR

REFERENCE TO PENDING APPLICATIONS

This application is not related to any pending application.

REFERENCE TO MICROFICHE APPENDIX

This application is not related to any microfiche appendix.

FIELD OF INVENTION

The present invention relates in general to a protective covering for guns and other similarly embodied structures. More particularly, the present invention relates to a method and casing for enveloping and protecting a firearm within a stretchably inclusive accommodation absent further necessity for supplemental securing means to retain the firearm once so inserted.

BACKGROUND OF INVENTION

Protective coverings and casings for firearms are well represented in the contemporary art. For example, U.S. Pat. No. 3,540,508 purports to disclose and claim a protective cover for a firearm having a stock and elongated barrel generally including an elongated tubular member consisting of a woven stretchable material for receiving the firearm therein, the tubular member having a closed end and an open end into which the firearm is inserted. As distinguished from the present invention, the "508" patent limitedly provides for insertion of a firearm into a tubular member via an open end of the member. Consequently, the "508" patent lacks the ease of positioning teachings of the present invention wherein deployment and practice of the invention may be effectuated via a substantially elongated opening located along the invention's bottom edge (versus narrow end "insertion" opening of "508" reference).

U.S. Pat. No. 3,701,371 purports to disclose and claim a gun case made of light, flexible material, and capable of being rolled or folded to fit into a pocket holder for storage and carrying. The gun case is designed to be folded into a packet small enough to be carried in a person's shirt pocket. In one embodiment the gun case is rolled or folded into a pocket holder formed as an integral part of the gun case at one end thereof. The gun case may have openings formed therein by which a person may operate the trigger while the gun is in the case, or by which a person may insert a cartridge clip, or it may include other openings for ejection of spent cartridges. As distinguished from the present invention, the "371" patent shares a deficiency noted in association with U.S. Pat. No. 3,540,508 and only limitedly provides for insertion of a firearm into a tubular member via an open end of the member. Consequently, the "371" patent lacks the ease of positioning teachings of the present invention wherein deployment and practice of the invention may be effectuated via a substantially elongated opening located along the invention's bottom edge (versus narrow end "insertion" opening of "371" reference).

U.S. Pat. No. 6,256,922 B1 purports to disclose and claim a firearm casing for protecting a firearm from the elements while allowing the user to access the firearm handle or sight and trigger. The firearm casing having a body with a front portion, a rear portion, an upper longitudinal edge, a lower longitudinal edge, an end flap, a terminal aperture, an upper flap and a lower flap. The lower longitudinal edge having an access opening permitting insertion of a firearm and access to the trigger. The access opening covered by the lower flap with fastening means. The upper longitudinal edge defining an upper aperture for accessing a handle or sight and the insertion and ejection of shells. The upper opening covered by the upper flap, which protects the firearm from the elements. The preferred fastening means used throughout being a hook and loop fastener such as VELCRO®. The terminal aperture may have a fastening means for closing the terminal aperture to prevent foreign objects such as dirt and debris from entering the barrel of the firearm through the open end. As distinguished from the present invention the "922" patent is clearly absent claim and disclosure regarding a lower edge portion which doesn't require a longitudinal extension throughout the entire length of the gun casing. The present invention's less expansive opening in combination with its resiliently tensioned material thus enhances the art beyond that disclose in the "922" patent by providing a far more secure and demanding insertion capability. This enhanced insertion capability results in minimizing likelihood of inadvertently dropping or otherwise mishandling the firearm during its positioning process. Further the present invention's stock and barrel body portions capture the firearm during this positioning process and in combination with its resiliently tensioned material provide a means by which the firearm may be held in place and transported absent necessity for fasteners required and disclosed in the "922" reference.

U.S. Pat. No. 6,626,339 B2 purports to disclose and claim a holder mounted bag, comprising a flexible case configured to enclose an object and a portion of a holder upon which the object is disposed, and configured to be opened to allow access to the object while the case remains attached to the holder. The bag includes an object opening sized to receive the object therethrough, and at least one holder opening sized to receive a portion of the holder therethrough. As distinguished from the present invention, the "339" patent is clearly directed towards (and claims) a holder attached to a mountedly affixed holder. The present invention requires no such "holder" affixation to effectuate its practice. In addition, further structural distinctions may be readily observed when comparing the featured elements of the "339" reference to those disclosed in the present application.

U.S. Pat. No. 5,024,997 purports to disclose and claim a gun case including means for suspending the gun case from a support in such a manner that the gun case may be conveniently stored. The gun case includes at least one openable loop securely attached thereto and receivable around a support such as a clothes rod or a hanger to permit the gun case to be suspended from the support. The openable loops supporting the gun case are releasably secured by metal snaps, buckles or Velcro straps. The gun case may be provided with a rigid hanger receiving a pair of spaced openable loops and permitting the gun case to be suspended from the rod of a clothes closet. The gun case may also be provided with means for permitting the gun case to be attached to a belt and thereby form a holster and including a resilient bumper secured to the end of the gun case to protect the muzzle of a gun received in the gun case and zipper-like slidable fastener means which permit access to the gun within the gun case such that the gun therein may be easily removed when the gun case is used as a holster. In stark contrast to the present invention, the "997" patent discloses, relies upon and claims a combination of a hollow case body having a muzzle end and a butt end for receiving a gun therein, an identification card holder secured to the butt end and a pair of openable loops for removably suspending the gun case from a shaft. The openable loops extend from the card holder and each include a detachable connection for opening and closing the openable loops, whereby the openable loops, when closed, can be removably attached to opposite ends of the shaft and embrace the shaft and, when open, can be removed from the shaft, whereby the gun case may be removably and vertically suspended from the shaft and in generally coplanar relationship with a vertical plane including the shaft. The present invent, is absent any reliance upon the claimed structural elements and disclosure of the "997" reference.

Further examples of protective coverings for firearms would include U.S. Pat. No. 2,542,667 which purports to disclose and claim a gun carrying case, U.S. Pat. No. 2,574,730 purports to disclose and claim a gun case, and U.S. Pat. No. 2,913,030 which purports to disclose and claim a moisture-free bag for storage or firearms, fishing tackle and other such corrosive objects.

Consequently, given the deficiencies of the above-noted art and other representative teachings, it is clear what is needed is a casing and method for enveloping and protecting a firearm within a stretchably inclusive accommodation absent further necessity for supplemental securing means to retain the firearm once so inserted.

SUMMARY OF INVENTION

In view of the foregoing and other consideration, the present invention relates to a method and casing for enveloping and protecting a firearm. Consequently, it is a benefit teaching and claim of the present invention to provide, disclose and claim a gun protector/casing for enveloping and protecting a firearm where the casing comprises a body section made of a resiliently stretchable material, such as latex based compositions including without limitation, rubber, elastic and neoprene. The body section further comprises a front portion, a middle portion, a rear portion, an upper edge and a plurality of lower edges with the upper edge extending longitudinally between a firearm barrel end of the casing and a firearm stock end of the casing. The barrel end of the casing typically, though not limitedly, may be comprised of a latex based environmentally impervious material compound and dimensioned to essentially surround an exiting projectile barrel portion of a firearm of a latex based, environmentally impervious material when insertably introduced to the interior portion of the case. The firearm stock end of the case may be likewise comprised of a latex based, environmentally impervious material and dimensioned to essentially surround the stock portion of a firearm when insertably introduced to the interior portion of the case. The barrel and stock ends of each may respectfully extend outwardly from the front and rear portion of the body for a distance of between 1 to 10 inches. A plurality of lower edges extend longitudinally between the firearm stock end of the casing and the front body portion of the body section. A looped handle may be further attached to the firearm stock end of the casing portion.

A further object of the present invention is to provide a casing for enveloping and protecting a firearm wherein a plurality of lower edges allows for ready access to the firearm once insertably retained within the casing.

Yet another object of the present invention is to provide a casing for enveloping and protecting a firearm which allows the firearm to be transported and retained therein while attached to a human via an integrated shoulder strap/sling.

Another object of the present invention is to contemplate and disclose means for optionally attaching each of said plurality of lower edges to one another to further secure a firearm once enveloped within the casing.

Another objective of the present invention is to disclose and teach a casing for enveloping and protecting a firearm wherein an opening through which a firearm may be introduced to the interior portion of the casing need not longitudinally traverse the entire length of the gun casing.

Yet another objective of the present invention is to contemplate and disclose a casing for enveloping a firearm wherein having once insertably positioned a firearm within the casing, the firearm may be held in place absent necessity for fasteners such as but not limited to VELCRO®, clasps, zippers, snaps, and other similarly intended "closing" structures.

Another objective of the present invention is to contemplate, disclose and claim a casing for enveloping and protecting a firearm wherein resiliently stretchable body portions of the casing may be relied upon to expand and retract in a manner sufficient to allow a firearm to be received through a casing opening, and then retained in place.

BRIEF DESCRIPTION OF DRAWINGS

For a more complete understanding of the present invention, and the advantages thereof, reference is now made to the following descriptions taken in conjunction with the accompanying drawings, in which.

DETAILED DESCRIPTION OF THE INVENTION

While making and using of various embodiments of the present invention are discussed in detail below, it should be appreciated that the present invention provides for inventive concepts capable of being embodied in a variety of specific contexts. The specific embodiments discussed herein are merely illustrative of specific manners in which to make and use the invention and are not to be interpreted as limiting the scope of the present invention.

The claims and specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

FIGS. 1 through 5 disclose the essential components and resiliently tensioned accommodating mechanism of the present invention. Turning now to FIGS. 1 through 5.

Figure 1:
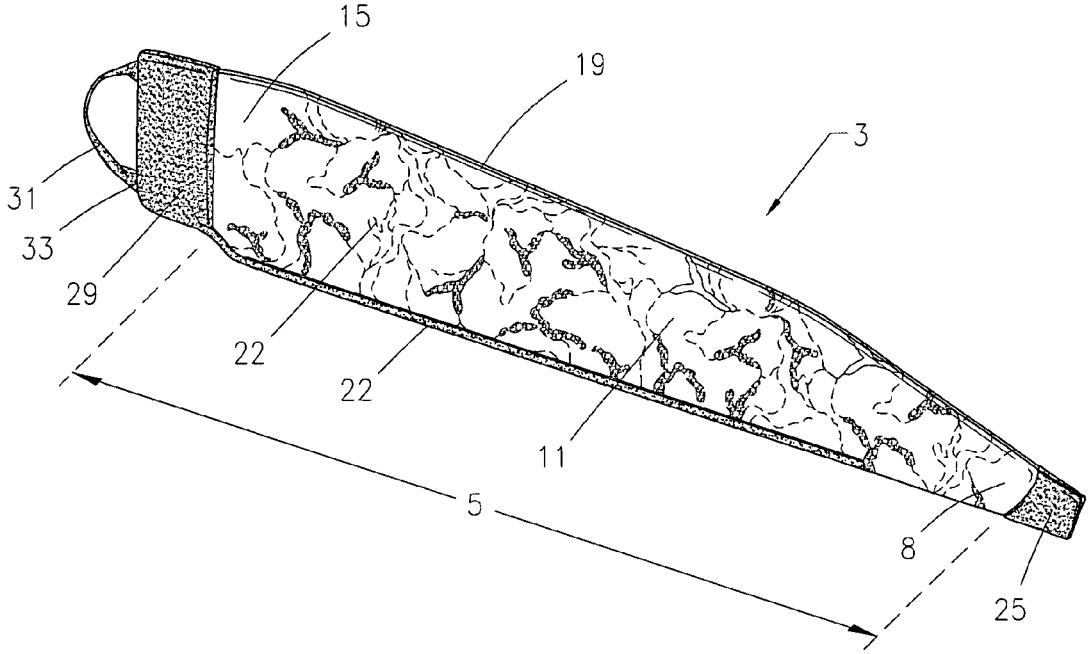
FIG. 1 is a perspective view illustration of the invention providing detailed disclosure of the invention's primary components.

In FIGS. 1 through 5, it may be observed where the casing for enveloping and protecting a firearm is generally referred to as 3. The casing comprises a body section 5 having a front portion 8, a middle portion 11, a rear portion 15, an upper edge 19, and a plurality of lower edges 22. The upper edge 19 extends longitudinally between a firearm barrel end 25 of the casing 3 and firearm stock end 29 of the casing 3. In a preferred embodiment of the invention the upper edge 19 is non-seamed. However, as will be readily appreciated by those skilled in the art, the upper edge 19 may be a common seam joining halved, or other severable portions of body section 5. The firearm barrel end 25 of the casing is close-ended and dimensioned to essentially surround the ending barrel portion 42 of a firearm 40 when insertably positioned therein. The firearm stock end 29 of the casing 3 is similarly close-ended and dimensioned to essentially surround the stock portion 44 of a firearm 40 when insertably positioned therein. A plurality of lower edges 22 extend longitudinally between the firearm stock end 29 of the casing 3 and the front body portion 8 of the body section 5. In FIG. 1, it may be further observed where the internal portion of casing 3 is shown as element 26, with crosshatching designating a resiliently stretchable material such as, but not limited to, neoprene, rubber, elastic and other latex based compositions. Such resiliently stretchable material relied upon to effectuate operational deployment of the invention's practice. Element 31 in the present application's Figures clearly illustrates a should strap/sling (a.k.a. "handle") which allows casing 3 to be transported from place to place following insertion therethrough of a human appendage, such as an arm.

Figure 2:
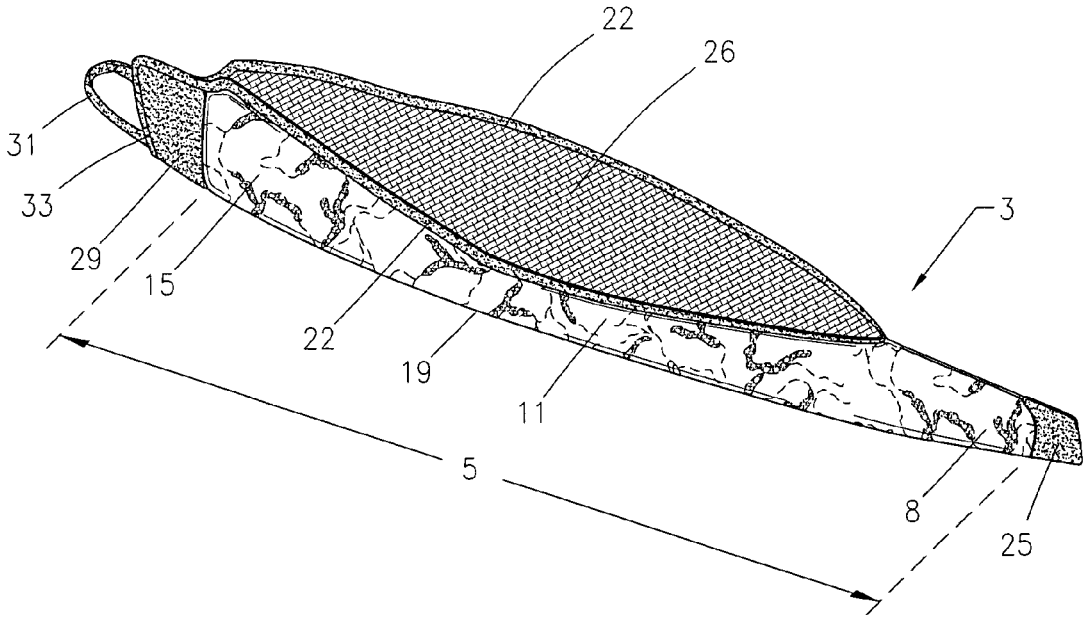
FIG. 2 is an additional perspective view illustration of the invention (opposite that provided in FIG. 1) providing detailed disclosure of the invention's primary components.
Figure 3:
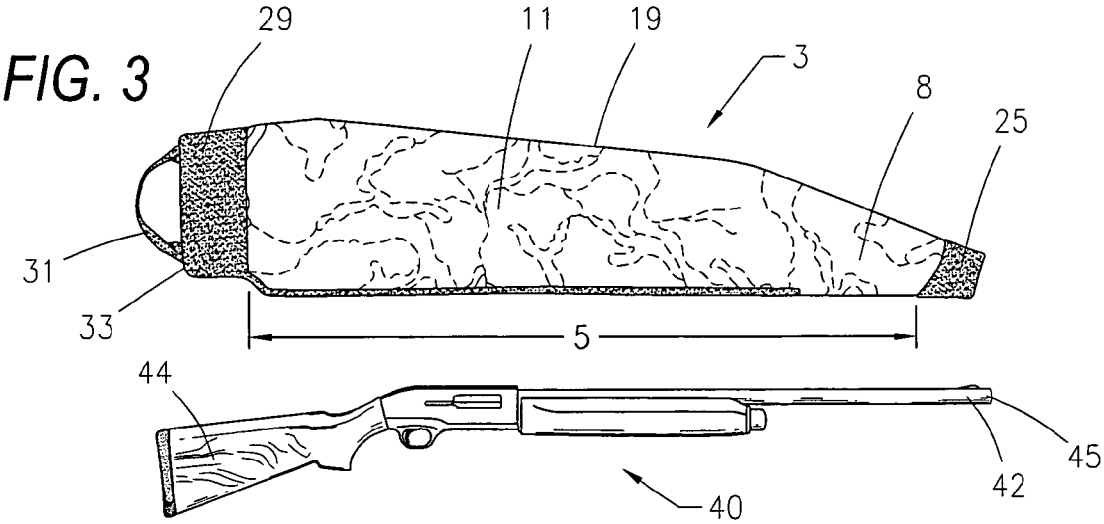
FIG. 3 illustrates an embodiment of the present invention prior to introducing a firearm to the internal portion of the invention's casing.
Figure 4:
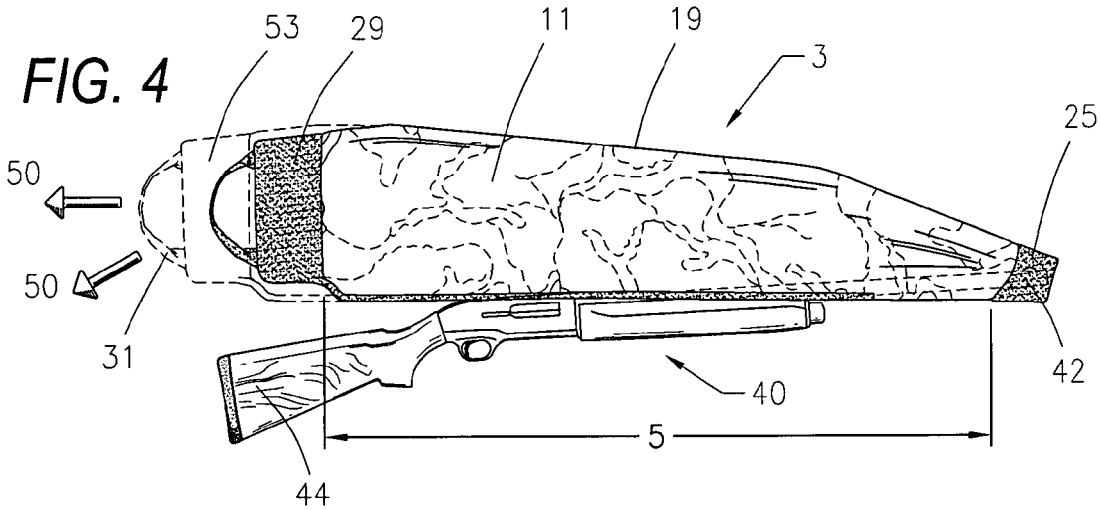
FIG. 4 illustrates an in-progress insertion of a firearm to the internal portion of the casing of the present invention.
Figure 5:
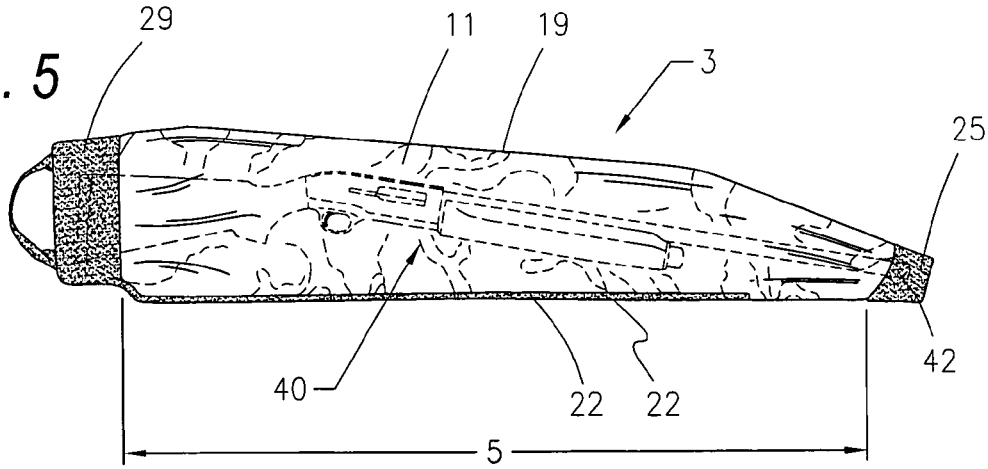
FIG. 5 illustrates a firearm securely retained within the casing of the present invention after insertion (firearm in hyphenated lines).

Continuing with particular reference to FIG. 2, it is contemplated, disclosed and claimed that lower edges 22 may further comprise one or more lower edge fastening means wherein the fastening means may be deployed to impermanently attach the lower edges 22 to one another. The fastening means so contemplated are intended to include, but not be limited to, Velcro®, snaps, clasps, and indeed, zippers which may be attached or inserted at one or more points, above, below or along the longitudinal lines of lower edges 22. FIGS. 3 through 5 provide additional disclosure detail with respect to the stretchable accommodations of a firearm 40 within casing 3. Turning now with particular reference to FIGS. 3 through 5.

In FIGS. 3 through 5, firearm 40 is shown having a barrel end 42 stock end 44 and projectile exiting end/orifice 45. The body portion 5 of casing 3 is comprised of a stretchable material to allow for the accommodation of firearm 40 within the internal portion of casing 3 (Ref. 26, FIG. 2). Invention practice methodology facilitates such accommodation calls for barrel portion 42 of firearm 40 to be inserted within barrel end 25 of casing 3, and stock end 44 of firearm 40 to be inserted within the stock end 29 portion of casing 3. It will be noted in FIGS. 3 through 5 where barrel end 25 and stock end 29 are intended to non-limitedly reflect a sealed, latex-based or other similarly intended structure to surroundingly encapsulate the butt 44 and barrel 42 portion of gun 40.

In FIG. 4 particularly, it may be observed where the body portion 5 is stretched along lines 50 typically by motivating handle 31 to influence the expanding capacity 53 of case 3 to sizably accommodate gun 40 within the case's internal portion 26. Having once stretched or otherwise expanded body portion 5 along lines 50, rifle 40 is inserted within the internal portion 26 of case 3 and body portion 5 is allowed to retract from its expanded state to encapsulate stock 44 within stock portion 29 of case 3, and barrel 42 within barrel end 25 of case 3.

Though not illustrated in the above figures, it is to be noted that the body 5 and end portions 29 and 25 may be designed to present a camouflaged appearance or other color/design of the consumer's preference.

Although the invention has been described with reference to specific embodiments, these descriptions are not meant to be construed in a limiting sense. Various modifications of the disclosed embodiments, as well as alternative embodiments of the invention will become apparent to persons skilled in the art upon reference to the description of the invention. It should be appreciated by those skilled in the art that the conception and the specific embodiment disclosed might be readily utilized as a basis for modifying or designing other structures for carrying out the same purposes of the present invention. It should also be realized by those skilled in the art that such equivalent constructions do not depart from the spirit and scope of the invention as set forth in the appended claims.

It is therefore, contemplated that the claims will cover any such modifications or embodiments that fall within the true scope of the invention.

What is claimed is:

1. A casing for enveloping and protecting a firearm comprising:

a body section having a front portion, a middle portion, a rear portion, an upper edge and a plurality of lower edges;

a firearm barrel end and a firearm stock end, wherein the firearm barrel end and the firearm stock end are attached to the body section;

the upper edge extending longitudinally between the firearm barrel end of the casing and the firearm stock end of the casing, the firearm barrel end of the casing dimensioned to essentially surround the ending barrel portion of a firearm when insertably introduced therein and the firearm stock end of the casing dimensioned to essentially surround a stock portion of a firearm when insertably introduced therein;

the plurality of lower edges extending longitudinally between the firearm stock end of the casing and the front portion of the body section; and wherein the firearm stock and barrel ends of the casing are comprised of a latex based compound and each respectively extend outwardly from the front and rear portion of the body respectively for a distance of between 1 to 10 inches.

2. The casing of claim 1 wherein said body portion is comprised of a resiliently tensioned material.

3. The casing of claim 1 further comprising a looped handle attached to the firearm stock end of the casing portion.

4. The casing of claim 1, further comprising one or more lower edge fastening means in communication with the body portion wherein the fastening means may be deployed to impermanently attach each of the lower edges to one another.

5. The casing of claim 1, further comprising one or more lower edge fastening means in communication with the body wherein the fastening means may be deployed to impermanently and contiguously attach two or more of lower edges to one another.

6. The firearm casing of claim 1, further comprising:

the body being generally contoured to the shape of the firearm when the firearm casing stretchably accommodates the firearm.

7. The firearm casing of claim 1 further comprising material presenting a camouflage print design.

8. The firearm casing of claim 1 wherein the body portion is comprised of two material sections joined together by a sewn or bonded seam extending the length of upper edge.

9. A casing for enveloping and protecting a firearm comprising:

a single piece body section made of a resiliently tensioned material and having a front portion, a middle portion, a rear portion, an upper edge and a plurality of lower edges;

a firearm barrel end and a firearm stock end, wherein the firearm barrel end and the firearm stock end are attached to the single piece body section;

the upper edge extending longitudinally between the firearm barrel end of the casing and the firearm stock end of the casing, the firearm barrel end of the casing comprised of a latex based compound and dimensioned to essentially surround the exiting projectile barrel portion of a firearm when insertably introduced therein and the firearm stock end of the casing comprised of a latex based compound and dimensioned to essentially surround a stock portion of a firearm when insertably introduced therein;

the barrel and stock ends of the casing comprised of the latex based compound and each respectfully extending outwardly from the front and rear portion of the body for a distance of between 1 to 10 inches, the plurality of lower edges extending longitudinally between the firearm barrel end of the casing the front body portion of the body section; and a looped handle attached to the firearm stock end of the casing portion.

10. The casing of claim 9, further comprising one or more lower edge fastening means in communication with the body portion wherein the fastening means may be deployed to impermanently attach two or more of lower edges to one another.

11. The casing of claim 9, further comprising one or more lower edge fastening means in communication with the body wherein the fastening means may be deployed to impermanently and contiguously attach two or more of lower edges to one another.

12. The firearm casing of claim 9, further comprising:

said body being contoured to the shape of a firearm wherein said firearm casing stretchably encases said firearm.

13. The firearm casing of claim 9 further comprising material being camouflage print.

14. The firearm casing of claim 9 wherein the body portion is comprised of two material sections joined together by a sewn or bonded seam extending the length of the upper edge.

15. A casing for enveloping and protecting a firearm comprising:

a body section made of a resiliently tensioned material and having a front portion, a middle portion, a rear portion, an upper edge and a plurality of lower edges;

a firearm barrel end and a firearm stock end, wherein the firearm barrel end and the firearm stock end are attached to the body section;

the upper edge extending longitudinally between the firearm barrel end of the casing and the firearm stock end of the casing, the firearm barrel end of the casing comprised of a latex based compound and dimensioned to essentially surround the exiting projectile barrel portion of a firearm when insertably introduced therein and the firearm stock end of the casing comprised of a latex based compound and dimensioned to essentially surround a stock portion of a firearm when insertably introduced therein;

the firearm barrel and stock ends of the casing comprised of the latex based compound and each respectfully extending outwardly from the front and rear portion of the body for a distance of between 1 to 10 inches, the plurality of lower edges extending longitudinally between the firearm stock end of the casing the front body portion of the body section;

a looped handle attached to the firearm stock end of the casing portion; and wherein a firearm is contained within the body section and the firearm barrel and stock ends of said firearm casing.

16. The casing of claim 15, further comprising one or more lower edge fastening means in communication with the body portion wherein the fastening means may be deployed to impermanently attach two or more of lower edges to one another.

17. The casing of claim 15, further comprising one or more lower edge fastening means in communication with the body wherein the fastening means may be deployed to impermanently and contiguously attach each of the lower edges to one another.

18. The firearm casing of claim 15, further comprising:

said body being contoured to the shape of a firearm wherein said firearm casing stretchably encases said firearm.

19. The firearm casing of claim 15 further comprising material being camouflage print.

20. The firearm casing of claim 15 wherein the body portion is comprised of two material sections joined together by a sewn or bonded seam extending the length of upper edge.

21. A method to envelop and protect a firearm comprising:

providing a casing having a body section made of a resiliently tensioned material and having a front portion, a middle portion, a rear portion, an upper edge and a plurality of lower edges, the upper edge extending longitudinally between a firearm barrel end of the casing and a firearm stock end of the casing, the firearm barrel end and the firearm stock end are attached to the body section, the firearm barrel end of the casing comprised of a latex based compound and dimensioned to essentially surround the exiting projectile barrel portion of a firearm when insertably introduced therein and the firearm stock end of the casing comprised of a latex based compound and dimensioned to essentially surround a stock portion of a firearm when insertably introduced therein;

the firearm barrel and stock ends of the casing comprised of the latex based compound and each respectfully extending outwardly from the front and rear portion of the body for a distance of between 1 to 10 inches, the plurality of lower edges extending longitudinally between the firearm stock end of the casing the front body portion of the body section and a looped handle attached to the firearm stock end of the casing portion; and insertably introducing a firearm to the internal portion of the case in a manner causing a stock portion of the firearm to be positionally captured by the firearm stock end of the casing and the exiting projectile barrel portion of a firearm be positionally captured by the barrel end of the casing.

* * * * *